United States Patent [19]

Jackson et al.

[11] Patent Number: 4,472,704

[45] Date of Patent: Sep. 18, 1984

[54] PRESSURE-OPERATED SWITCH FOR A HIGH-VOLTAGE INTERRUPTING MODULE

[75] Inventors: Hiram S. Jackson, Skokie; Henry W. Scherer, Chicago, both of Ill.

[73] Assignee: S&C Electric Company, Chicago, Ill.

[21] Appl. No.: 524,180

[22] Filed: Aug. 17, 1983

[51] Int. Cl.[3] ..... H01H 85/00

[52] U.S. Cl. ..... 337/6; 337/159

[58] Field of Search ..... 337/4, 6, 30, 35, 143, 337/158, 159, 161, 162, 401, 409

[56] References Cited

U.S. PATENT DOCUMENTS

| | | | |
|---|---|---|---|
| 3,118,986 | 1/1964 | Lewis et al. | 337/409 X |
| 3,239,631 | 3/1966 | Snell | 337/30 |
| 3,291,937 | 12/1966 | Carothers et al. | 337/30 |
| 3,851,219 | 11/1974 | Kozorezov et al. | 337/401 X |

*Primary Examiner*—George Harris

*Attorney, Agent, or Firm*—John D. Kaufmann

[57] ABSTRACT

An improved switch for a high-voltage device in which ignition of a power cartridge moves an insulative piston located in a conductive member, into a passageway in an insulative liner, said piston moving a contact through the passageway and away from the conductive member to break an electrical interconnection between the conductive member and the movable contact, the switch including an insulative housing, an annular groove formed in the outside of the conductive member;

an annular groove formed in the inside of the housing; and a split ring partially residing in both of the grooves when axially aligned, preventing relative axial movement between the conductive member and the housing.

11 Claims, 4 Drawing Figures

PRESSURE-OPERATED SWITCH FOR A HIGH-VOLTAGE INTERRUPTING MODULE

BACKGROUND OF THE INVENTION

1. Field of the Invention

The present invention relates to an improved pressure-operated switch for a high-voltage interrupting module. More specifically, the present invention relates to an improvement of the switches disclosed in commonly assigned U.S. Pat. No. 4,342,978, issued Aug. 3, 1982 in the name of Meister, and U.S. Pat. No. 4,370,531, issued Jan. 25, 1983 in the name of Tobin, and in the following commonly assigned U.S. patent applications: Ser. No. 179,367, filed Aug. 18, 1980 (now abandoned in favor of continuation application Ser. No. 550,201, filed Nov. 9, 1983) in the name of Jarosz and Panas; Ser. No. 179,366, filed Aug. 18, 1980 (now abandoned in favor of continuation application Ser. No. 539,396, filed Oct. 6, 1983) in the name of O'Leary, and Ser. No. 437,925, which issued Jan. 24, 1984 as U.S. Pat. No. 4,427,963, and Ser. No. 437,926, both filed Nov. 1, 1982 in the names of Jarosz and Panas.

2. Prior Art

The above patents and patent applications all relate to various aspects of a pressure-operated switch and to a high-voltage interrupting module containing the switch. The switch includes a pair of contacts, which are normally electrically interconnected by direct abutment therebetween or, preferably, by interconnecting them with a shearable or tearable metallic disc or membrane. In preferred embodiments of the switch, one of the contacts is stationary, while the other is movable, although both may be movable. The contacts are separable along a fixed line of direction to open a gap therebetween, thereby opening the switch. One of the contacts, preferably the stationary contact, contains a bore which, in conjunction with a piston or trailer, defines a closed chamber. The chamber houses a power cartridge or similar pressure-generating device.

The switch may be in electrical shunt with a fuse, a fusible element of which, as well as the switch, are preferably housed within a common housing. When the switch is closed (when the contacts thereof are electrically interconnected), the resistance of the current path through the switch is much lower than resistance of the current path through the fusible element, and, accordingly, a majority of the current flowing through the module flows through the switch. In this way, the module has a very high continuous current rating. Upon opening the switch, current is rapidly commutated therefrom to the fusible element where the current is interrupted. Separation of the contacts is achieved by igniting the power cartridge, which evolves high pressure within the chamber. This high pressure acts against the piston and the forces produced thereby rapidly move the piston to rapidly drive the movable contact away from the stationary contact, breaking the normal electrical interconnection and opening the switch. The power cartridge may be ignited in response a trigger signal produced by apparatus which senses a fault current or other over-current in a circuit in which the interrupting module is connected for protection thereof. The trigger-signal-producing apparatus may be that which is disclosed in commonly assigned U.S. patent applications, Ser. Nos. 506,942; 506,943; and 506,944, all filed June 22, 1983 in the name of Ruta.

Specific embodiments of the switch include a second stationary contact having a bore lined with an insulative sleeve. The movable contact is a conductive member covered with an insulative sleeve. When the movable contact is driven away from the first stationary contact, a second disc, which normally interconnects the movable and second stationary contact, is sheared, and the movable contact is telescoped into the second stationary contact producing a second gap therebetween.

The movable contact and the piston move away from the first stationary contact and through a passageway of an insulative liner. Both the movable contact and the piston are received by the passageway in the liner to physically isolate the movable contact from the ignition products of the power cartridge. This isolation prevents or suppresses the formation of any arc between the separating contacts and between the stationary contacts. In preferred embodiments of the switch, the stationary contacts and the liner are engageably surrounded, and have their relative positions fixed, by an insulative housing, which maintains the stationary contacts and the liner in end-to-end abutment with the bores and the passageway axially aligned.

Federal and state shipping regulations require that products such as the above described switch—products containing power cartridges, or similar ignitable devices—remain integral or "self contained" when subjected to a variety of conditions including fire. Tests of early versions of the above-described switch, wherein the insulative housing was cemented or adhered to the stationary contacts and the liner, showed that the heat of an external fire might, in some cases, degrade the cement or adhesive, as well as effect ignition of the power cartridge. The pressure build up within the switch following power cartridge ignition and the degradation of the cement or adhesive might, it was found, result in the stationary contacts being forced out of and separating from the housing. Obviation of the separation of the stationary contact from the housing is a primary object of the present invention.

SUMMARY OF THE INVENTION

With the above and other objects in view, the present invention contemplates an improved switch for a high-voltage device. The switch which is improved by this invention is of the type which includes an insulative housing open at one end and in which intentional ignition of a power cartridge produces pressure to move a movable contact away from a stationary contact. The stationary contact is engageably surrounded by and closes the one end of the housing. Movement of the movable contact away from the stationary contact opens the switch. If the switch is subjected to high external heat for a sufficient time, two effects may result. First, the engagement between the housing and the stationary contact may be degraded to thereafter permit the stationary contact to move relatively to the housing. Second, the high heat may unintentionally ignite the power cartridge so that the pressure produced thereby moves the stationary contact out of the housing.

In the improved switch, a first groove is formed in at least a portion of the exterior circumference of the stationary contact. A second groove is formed in at least a portion of the interior circumference of the housing. A shear-resistant facility resides in both of the grooves when they are adjacent and prevents relative movement of the stationary contact in the housing. In preferred embodiments, both grooves are generally annular and the shear-resistant facility is a generally annular split ring which resides in both grooves in a compressed state.

In other embodiments of the improved switch, the stationary contact, with the ring held in the first groove, is telescoped into the housing until the grooves are adjacent and the ring enters the second groove. This telescoping may result in material being shaved from the interior of the housing by the ring. Accordingly, in a specific embodiment, the first groove is wider than the ring thickness in the direction of the telescoping. In this way, the shaved material is able to reside in a volume defined by the ring and the first groove, after the grooves are adjacent. Consequently, the ring is not prevented from entering the second groove by the shaved material.

The housing of the switch may be open at both ends and a second stationary contact may close the other end. In this event, the second stationary contact has a groove formed therein and the housing has another groove formed therein; a second shear-resistant facility or split ring resides in both of these grooves, when such are adjacent, to prevent relative movement of the second stationary contact and the housing.

In all of the above embodiments, one or more split rings may reside in the adjacent grooves. Further, the stationary contacts in the housing may be affixed to each other by an adhesive residing at the interface therebetween. The stationary contacts may include a relieved region formed in the exterior thereof remote from the groove therein and the adhesive may reside in this relieved region. A hole may be formed through the housing to communicate with the relieved region when the grooves are adjacent and the adhesive may be placed in the relieved region through the hole.

DETAILED DESCRIPTION

Figure 1:
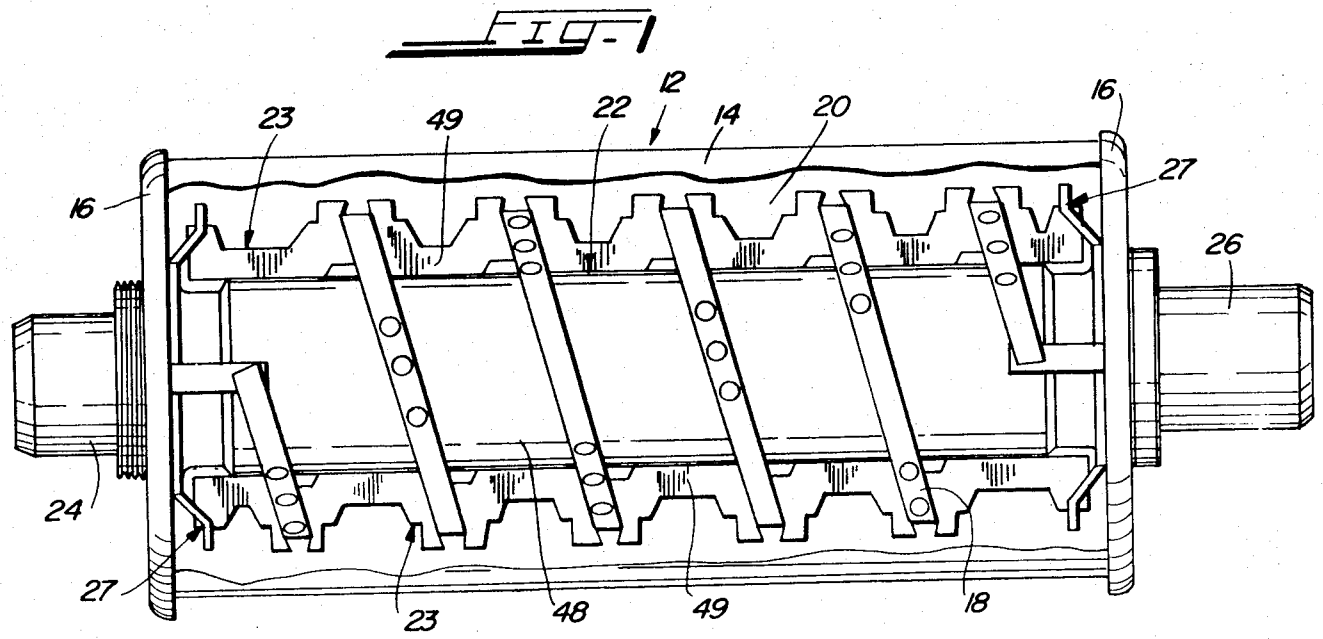
FIG. 1 is a front elevation of a portion of an interrupting module which includes an improved switch according to the present invention.

The present invention is usable with an interrupting module 12. Because the module 12 is more completely described in the above U.S. patents and patent applications, it is only generally depicted in the drawing hereof and only generally described herein.

Referring to FIG. 1, the module 12 includes a generally cylindrical open-ended insulative housing 14, which is closed by end plates 16. The housing 14 and the end plates 16 surround a fusible element 18 helically wound around a central axis of the housing 14 and may also surround a mass of a particulate fulgurite-forming medium, such as silica sand. The silica sand is in intimate engagement with the fusible element 18. The fusible element 18, which may be silver or copper, and the sand 20 interrupt fault currents or other over-currents therethrough in a current-limiting or energy-limiting manner, according to well-known principles. The fusible element 18 may be similar to those disclosed in commonly assigned U.S. Pat. No. 4,359,708, issued Nov. 16, 1982 or U.S. patent application Ser. No. 437,776 filed Oct. 29, 1982, both in the names of Jarosz and Panas.

The housing 14 also surrounds a switch 22 around which the fusible element 18 may be maintained in its helical configuration by insulative supports 23, such as those disclosed in commonly assigned U.S. patent application, Ser. No. 181,603, filed Aug. 27, 1980 in the names of Jarosz and Panas.

Figure 2:
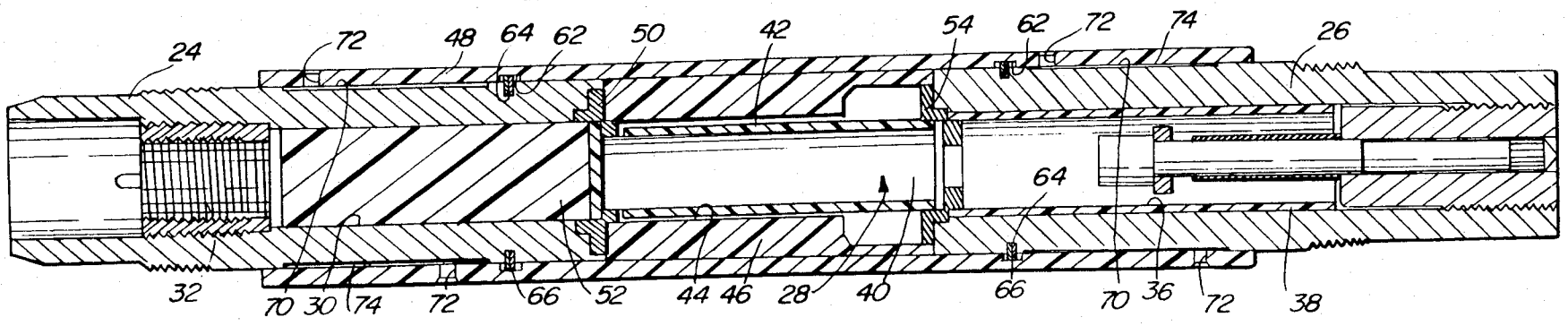
FIG. 2 is a sectioned front elevation of a portion of FIG. 1 which shows in greater detail the improved switch hereof.

Although the switch 22 may have numerous constructions in accordance with the above U.S. patent and patent applications, an exemplary embodiment is depicted in FIGS. 1 and 2. Specifically, the switch 22 includes a first conductive member 24, to which the left end plate 16 is mounted, and a second conductive member 26, to which the right end plate 16 is mounted. The first conductive member 24 serves as a first stationary contact while the second conductive member 26 serves as a second stationary contact. The ends of the fusible element 18 may be electrically connected to the stationary contacts 24 and 26 by facilities 27 described more fully in commonly assigned U.S. patent application Ser. No. 439,444, filed Nov. 5, 1982 in the name of Jarosz.

The switch 22 also includes a movable contact 28 (FIG. 2). Normally, the movable contact 28 is electrically continuous with both stationary contacts 24 and 26 so that a continuous low-resistance electrical path is formed therebetween. Because the resistance of this path is lower than the resistance of the fusible element 18, while the switch 22 is closed, as depicted in FIG. 2, the majority of the current flowing through the module 12 is normally shunted by the switch 22 away from the fusible element 18. When the switch 22 opens, the current formerly flowing through the stationary contacts 24 and 26 and the movable contact 28 is commutated to the fusible element 18 for interruption.

The first stationary contact 24 has a bore 30, at the left end of which a power cartridge 32, or other pressure-generating device, is located. The second stationary contact 26 also contains a bore 36, which may be lined with an insulative sleeve 38. The movable contact 28 may comprise a cylindrical conductive member 40 surrounded by an insulative sleeve 42. The movable contact 28 is normally located between the stationary contacts 24 and 26 and within the passageway 44 of an insulative liner located between the stationary contacts 24 and 26.

The stationary contacts 24 and 26 and their bores 30 and 36 are maintained in an aligned relationship, and the liner 46 is held in place therebetween, by an insulative housing 48 which engageably surrounds the liner 46 and the stationary contacts 24 and 26. The stationary contacts 24 and 26 and the liner 46 may be fixed to the housing 48 by a quantity of cement or adhesive. As shown in FIG. 1, the insulative support 23 may comprise a pair of notched fins 49. The fusible element 18 of the module 12 may be helically maintained about the housing 48 by the fins 49, as described in commonly assigned U.S. patent application, Ser. No. 181,603, filed Aug. 27, 1980 in the names of Jarosz and Panas.

With the movable contact 28 occupying the position shown in FIG. 2, the conductive member 40 thereof is electrically interconnected to the stationary contact 24 by a conductive shear disc 50 or other metallic diaphragm or member, which is shearable, tearable or the like. To the left of the diaphragm 50 is an insulative piston or trailer 52 adjacent to the movable contact. In the normal position of the movable contact 28 shown in FIG. 2, the piston 52 normally occupies the bore 30 in the first stationary contact 24.

The right end of the conductive member 40 is normally electrically interconnected to the second stationary contact 26 by a shear disc 54, which may be similar to the shear disc 50. The interior of the insulative sleeve 38 can receive the conductive member 40 with its insulative sleeve 42 thereon. Further, the bore 44 of the liner 46 can receive both the conductive member 40 with the insulative sleeve 42 thereon and the trailer 52.

Ignition of the power cartridge 32 effects the evolution of large quantities of high-pressure gas which act on the left end of the piston 52. The force applied to the piston 52 by the high pressure moves the piston 52 rightwardly and also moves rightwardly the movable contact 28. Rightward movement of the piston 52 and the movable contact 28 severs, rips or tears the discs 50 and 54, to break the electrical interconnection between the movable contact 28 and both stationary contacts 24 and 26 and two gaps. The fist gap is between the left end of the conductive member 40 and the right end of the first stationary contact 24; the second gap is between the right end of the conductive member 40 and the left end of the second stationary contact 26. Both gaps are insulated; the first gap by the reception of the piston 52 within the passageway 44 and the second gap by the reception of the insulative sleeve 42 within the bore 36. The reception of the piston 52 by the passageway 44 isolates the movable contact 28 and the second stationary contact 26 from the ignition products of the power cartridge 32, which may contain electrically conductive, arc-promoting materials.

When the switch 22 opens, the current previously flowing therethrough is commutated to the fusible element 18. The action of the fusible element 18 and of the silica sand 20 (FIG. 1) ultimately extinguishes this current, as is well known.

After tests of early versions of the module 12 as described above, it was found that when the switch 22 was subjected to the high heat of an external fire, the heat thereof might, in some cases, both degrade the adhesive or cement at the interface between the housing 48 and the stationary contacts 24 and 26 and cause ignition of the power cartridge 32, resulting in the switch 22 or the module 12 coming apart. This possibility was deemed to be undesirable. Specifically, because of the nature of the power cartridge 32, federal and state shipping regulations require that the "package" for the power cartridge 32—here, the housing 48 and the stationary contacts 24 and 26—must remain integral and "self-contained, " notwithstanding the subjection of the module 12 to a fire.

Figure 3A:
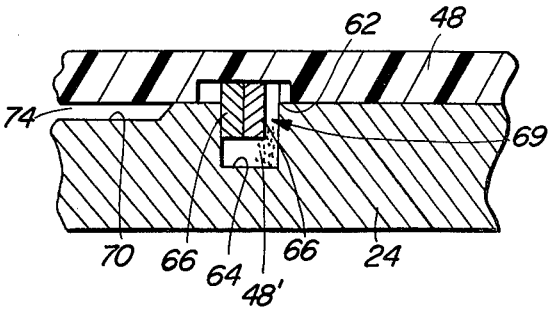
FIG. 3 is an enlargement of a portion of FIG. 2 showing the details of the present invention.
Figure 3B:
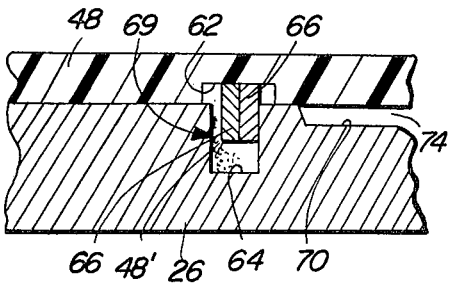
Figure 4:
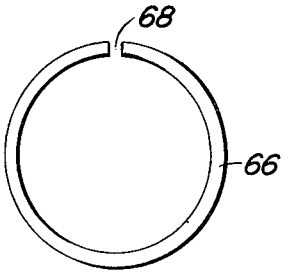
FIG. 4 is an enlarged elevation of a split ring which is depicted in FIGS. 2 and 3 and which is used to achieve the ends hereof.

Accordingly, and referring to FIGS. 2 and 3, the present invention provides for the formation of annular grooves 62 in the interior wall of the housing 48. An annular groove 64 is also formed in the exterior of each stationary contact 24 and 26. Prior to the contacts 24 and 26 being telescoped into the housing 48, one or more retaining rings 66 are placed in each groove 64. The ring 66, which is preferably made of spring temper carbon steel, is split, as at 68 (FIG. 4). In its free state, the inside diameter (ID) of the ring 66 is sufficiently larger than the outside diameter (OD) of the groove 64 to permit the ring 66 to be compressed until its exterior is flush with the OD of the stationary contacts 24 and 26. The free ID of the ring 66 is slightly smaller than the OD of the contacts 24 and 26. The free OD of the ring 66 is greater than the ID of the groove 62. The split 68 may be slightly opened and slid over the contacts 24 and 26 until it reaches the groove 64, whereupon the ring 66 is permitted to return to its free state and is held in the groove 64 with clearance between its ID and the OD of the groove 64. Thereafter, the contacts 24 and 26 are telescoped into the housing 48, closing the split 68 to compress the ring so that its OD is flush with the OD of the stationary contacts 24 and 26. Upon the ring 66 reaching the groove 62 and the grooves 62 and 64 being axially aligned or adjacent, it springs outwardly and is thereafter held in a somewhat compressed condition in both grooves 62 and 64, with its OD against the ID of the groove 62. In this way, the rings 66 lock the housing 48 and the contacts 24 and 26 against relative axial movement.

As may be seen in FIGS. 2 and 3, two or more rings 66 may be used in each pair of adjacent grooves 62,64 to increase the amount of shear force which may be resisted should the contacts 24 and 26 be subjected to axial forces by ignition of the power cartridge 32. Of course, a single ring 66 may be used if it is sufficiently robust in shear.

As best shown in FIG. 3, the grooves 64 are formed so that there is substantial axial clearance 69 between the side walls thereof and the side of the rings 66. This clearance 69 acts as a repository for material 48' which is "shaved" from the interior of the housing 48 by the rings 66 as the housing 48 and the contacts 24 and 26 are telescoped. Without the spaces 69, it has been found that the "shaved" material 48' may become sufficiently compacted to prevent the rings 66 from springing outwardly when the grooves 62 and 64 are adjacent. The clearance 69 prevents such compaction.

In order to seal the switch 22 and to prevent relative rotational movement between the housing 48 and the contacts 24 and 26, an adhesive or cement may be used. To this end the contacts 24 and 26 may be annularly relieved as at 70 and holes 72 may be formed through the housing 48. The holes 72 are located so as to communicate with an annular volume 74 defined between the relieved portions 70 of the contacts 24 and 26 and the interior of the housing 48 when the rings 66 are in both grooves 62 and 64. Adhesive or cement may be pumped into this volume 74 via one of the holes 72 until it emerges from the other hole 72. Thereafter, the adhesive or cement is allowed to set or cured.

The coaction of the rings 66 and the adhesive or cement seals the switch 22 and prevents any relative movement between the housing 48 and the contacts 24 and 26, regardless of the subjection of the module 12 to adverse external conditions, such as fires, which ignite the power cartridge 32 and degrade the adhesive or cement.

With these advantages and features in mind, it should be apparent that various changes, alterations, and modifications may be made to the preferred embodiment of the present invention as described herein, without departing from the spirit and scope of the present invention as defined in the appended claims.

We claim:

1. An improved switch for a high-voltage device; the switch being of the type which includes housing open at one end and in which ignition of a power cartridge produces pressure to move a movable contact, which is located within the housing, away from a stationary contact, which is engageably surrounded by, and closes the one end of, the housing, thereby opening the switch; wherein the improvement comprises:

a first groove formed in at least a portion of the exterior circumference of the stationary contact;

a second groove formed in at least a portion of the interior circumference of the housing; and shear-resistant means residing in both of the grooves when such are adjacent for preventing relative movement of the stationary contact and the housing.

2. An improved switch as in claim 1, wherein both grooves are generally annular, and the shear-resistant means is a generally annular split ring.

3. An improved switch as in claim 2, wherein the split ring resides in both grooves in a compressed state.

4. An improved switch as in claim 2; the switch being further of the type in which the stationary contact with the ring held in the first groove is telescoped into the housing until the grooves are adjacent and the ring enters the second groove, such telescoping resulting in material being shaved from the interior of the housing by the ring; wherein the improvement further comprises the first groove being substantially wider than the ring so that after the grooves are adjacent, the shaved material is able to reside in a volume defined by the first groove in the direction of the telescoping and the ring, whereby the ring is not prevented from entering the second groove by the shaved material.

5. An improved switch as in claim 3; the switch being further of the type in which the stationary contact with the ring held in the first groove is telescoped into the housing until the grooves are adjacent and the ring enters the second groove, such telescoping resulting in material being shaved from the interior of the housing by the ring; wherein the improvement further comprises the first groove being substantially wider than the ring so that after the grooves are adjacent, the shaved material is able to reside in a volume defined by the first groove in the direction of the telescoping and the ring, whereby the ring is not prevented from entering the second groove by the shaved material.

6. An improved switch as in claim 1; the switch being further of the type in which the housing is open at both ends and a second stationary contact closes the other end thereof; wherein the improvement further comprises a third groove formed in at least a portion of the exterior circumference of the second stationary contact;

a fourth groove spaced from the second groove and formed in at least a portion of the interior circumference of the housing; and second shear-resistant means residing in the third and fourth grooves when such are adjacent for preventing relative movement of the second stationary contact and the housing.

7. An improved switch as in claim 1, wherein both grooves are generally annular, and the shear-resistant means comprises two or more generally annular split rings.

8. An improved switch for a high-voltage device; the switch being of the type in which ignition of a power cartridge moves an insulative piston, which is normally located in a bore formed in a conductive member, away therefrom and into a passageway formed in an insulative liner, such movement of the piston moving a movable contact through the passageway and away from the conductive member to break an electrical interconnection between the conductive member and the movable contact, thereby opening the switch; the bore and the passageway being aligned; the switch including an insulative housing engageably surrounding, holding and fixing the relative positions of the conductive member and the liner; wherein the improvement comprises:

an annular groove formed in the outside of the conductive member;

an annular groove formed in the inside of the housing; and a split ring partially residing in both of the grooves when such are axially aligned, to prevent relative axial movement between the conductive member and the housing.

9. An improved switch as in claim 8, wherein the improvement further comprises:

an adhesive at the interface between the conductive member and the housing.

10. An improved switch as in claim 9, wherein the improvement further comprises:

a relieved region formed in the outside of the conductive member axially remote from the groove therein, the adhesive residing in the relieved region.

11. An improved switch as in claim 10, wherein the improvement further comprises:

a hole formed through the housing and communicating with the relieved region when the grooves are axially aligned, the adhesive being placed in the relieved region through the hole.

* * * * *

UNITED STATES PATENT AND TRADEMARK OFFICE

CERTIFICATE OF CORRECTION

PATENT NO. : 4,472,704

DATED : September 18, 1984

INVENTOR(S) : Hiram S. Jackson and Henry W. Scherer

It is certified that error appears in the above—identified patent and that said Letters Patent is hereby corrected as shown below:

Col. 5, line 20, "fist" should be --first--.

Col. 6, line 46, "cured" should be --cure--.

Col. 6, line 62, after "includes" insert --an insulative--.

Signed and Sealed this

*Second* Day of *April 1985*

[SEAL]

*Attest:*

DONALD J. QUIGG

*Attesting Officer* *Acting Commissioner of Patents and Trademarks*